US008556641B2

(12) United States Patent
Wilinski

(10) Patent No.: US 8,556,641 B2
(45) Date of Patent: Oct. 15, 2013

(54) LEVEL BRIDGES

(75) Inventor: Bernd Wilinski, Lemgo (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 13/221,973

(22) Filed: Aug. 31, 2011

(65) Prior Publication Data

US 2012/0077374 A1 Mar. 29, 2012

(30) Foreign Application Priority Data

Sep. 29, 2010 (DE) ..... 10 2010 037 846

(51) Int. Cl.
*H01R 12/00* (2006.01)

(52) U.S. Cl.
USPC ..... 439/75

(58) Field of Classification Search
USPC ..... 439/75, 82, 751, 507, 45
See application file for complete search history.

(56) References Cited

U.S. PATENT DOCUMENTS

| | | | | |
|---|---|---|---|---|
| 3,400,358 | A * | 9/1968 | Byrnes et al. | 439/75 |
| 3,660,726 | A * | 5/1972 | Ammon et al. | 174/262 |
| 4,171,861 | A | 10/1979 | Hohorst | |
| 4,446,505 | A * | 5/1984 | Long et al. | 361/785 |
| 4,944,684 | A * | 7/1990 | Leibowitz | 439/76.2 |
| 4,995,818 | A | 2/1991 | Saimoto | |
| 5,004,426 | A * | 4/1991 | Barnett | 439/82 |
| 5,761,050 | A * | 6/1998 | Archer | 361/791 |
| 7,083,431 | B1 * | 8/2006 | Darr et al. | 439/75 |
| 7,845,969 | B2 | 12/2010 | Stadler et al. | |
| 2009/0269985 | A1 | 10/2009 | Stadler et al. | |

FOREIGN PATENT DOCUMENTS

| | | |
|---|---|---|
| DE | 10255674 | 6/2004 |
| JP | 1-86179 | 6/1989 |
| JP | 2006047111 | 9/2006 |
| JP | 2007045850 | 9/2011 |

* cited by examiner

*Primary Examiner* — Phuong Dinh
(74) *Attorney, Agent, or Firm* — Schmeiser, Olsen & Watts, LLP

(57) ABSTRACT

A level bridge for electrically bridging two contacts located on top of each other in a fastening. The level bridge comprises a conductive section for electrically bridging two contacts located on top of each other and an elastic section allowing introduction and secure fastening. The conductive section and the elastic section of the level bridge are embodied in one piece. Additionally, a method for producing level bridges which comprises the step of punching a metallic material so that a metallic one-piece blank of a level bridge develops is also provided.

8 Claims, 5 Drawing Sheets

LEVEL BRIDGES

FIELD OF TECHNOLOGY

Figure 1:
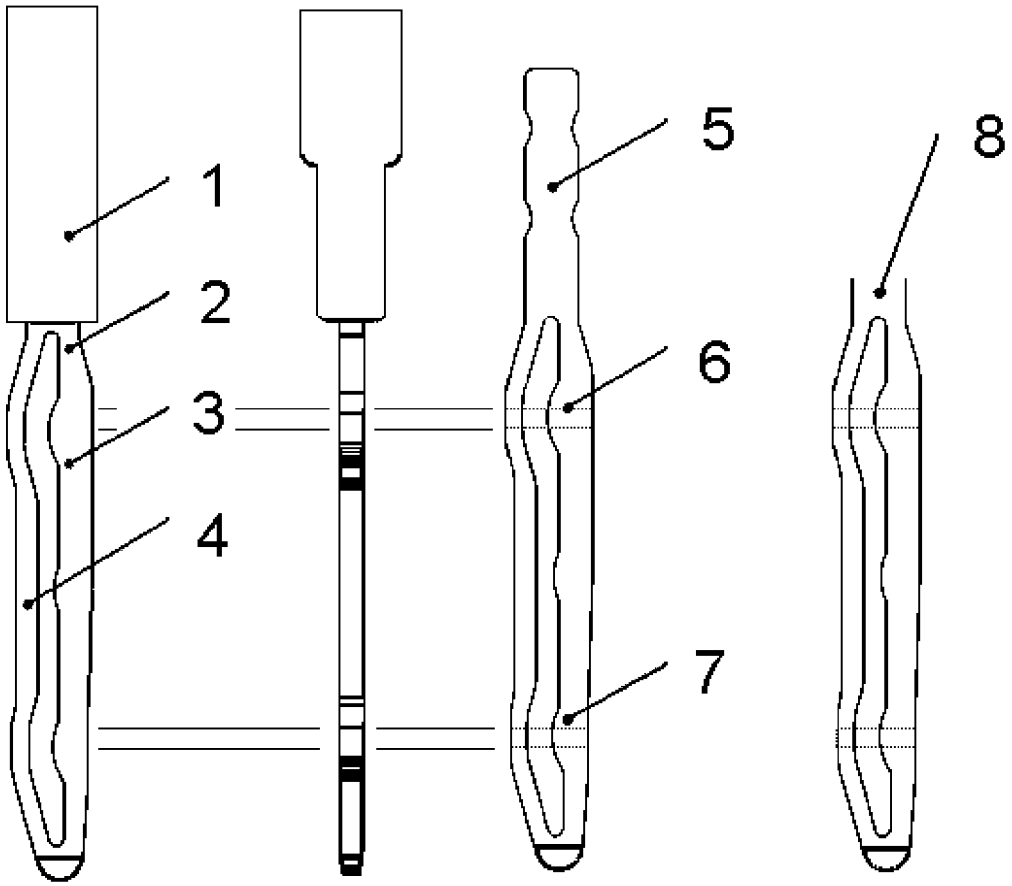

The following relates to level bridges.

BACKGROUND

Level bridges are known in prior art. They comprise a two-part structure, in which two metal sheets or wires are inserted at one side in a fastener.

It is disadvantageous in these level bridges that they can easily be jammed during insertion and here an opening develops at the end not held. This opening frequently leads to shearing so that the level bridge is destroyed during the attempted insertion or is severely compromised in its function.

In order to counter this disadvantage, it was frequently tried in the past to connect the end not held as well. For this purpose, classical connection techniques were used, such as soldering.

Even in these connected level bridges, the handling had to be done very carefully during the insertion process because the probability of shearing, although lower, still existed depending on the quality of the connection. Additionally, this second step was expensive and prone to errors.

Other level bridges additionally comprise one or more elastic arms in each level to be contacted. They too can easily jam during insertion, here additionally leading to the problem that the jamming can occur in each level.

Furthermore, the production of such level bridges is expensive because in multi-part components the positioning of the respective parts in reference to each other is very important.

Additionally, the known level bridges require a multitude of tools, for example punching, bending, and/or embossing tools, which also leads to increased production costs.

Additionally it is disadvantageous that multi-part components also require an increased storage expense for the basic parts in production.

In particular when the levels to be connected show only a short distance from each other, level bridges of prior art are unsuitable because the available elastic arms cannot be produced in a suitable fashion due to potential processing and material tolerances.

SUMMARY

Therefore the following disclosure provides level bridge addressing one or more disadvantages in an inventive fashion.

In one embodiment a level bridge for electrically bridging two contacts is positioned on top of each other in a fastener. This level bridge comprises a conductive section for bridging in an electric fashion two contacts located on top of each other and an elastic section, which allows the introduction and secure fastening. The conducting section and the elastic section of the level bridge are embodied in one piece.

In another embodiment of the invention the level bridge comprises an electrically non-conductive section to be inserted and/or retracted in a level clamp.

In another embodiment of the invention the conductive section comprises one or more stops limiting the deflection of the elastic section.

In another embodiment of the invention the conductive section comprises one or more stops, in which the conductive section and/or the conductive sections serve contacting an electric contact in the inserted state.

In another embodiment of the invention an elastic section is also embodied as a conductive section.

In another embodiment of the invention the elastic section and the conductive section are produced from a material comprising copper.

In another embodiment of the invention the elastic section and the conductive section are at least partially galvanized in advance.

In another embodiment of the invention the level bridge comprises a section that can be separated, serving exclusively for inserting and breaking off when retraction is attempted.

Additionally a method for the production of level bridges addresses the stated disadvantages. This method comprises a step of punching a metallic material so that a metallic one-piece blank of a level bridge develops.

In another embodiment of the invention the method comprises the step of spray-coating one end of the metallic material so that an electrically non-conductive section develops for inserting in and/or retracting from a level clamp.

BRIEF DESCRIPTION

In the following the invention is explained in detail using the figures.

Figure 2:
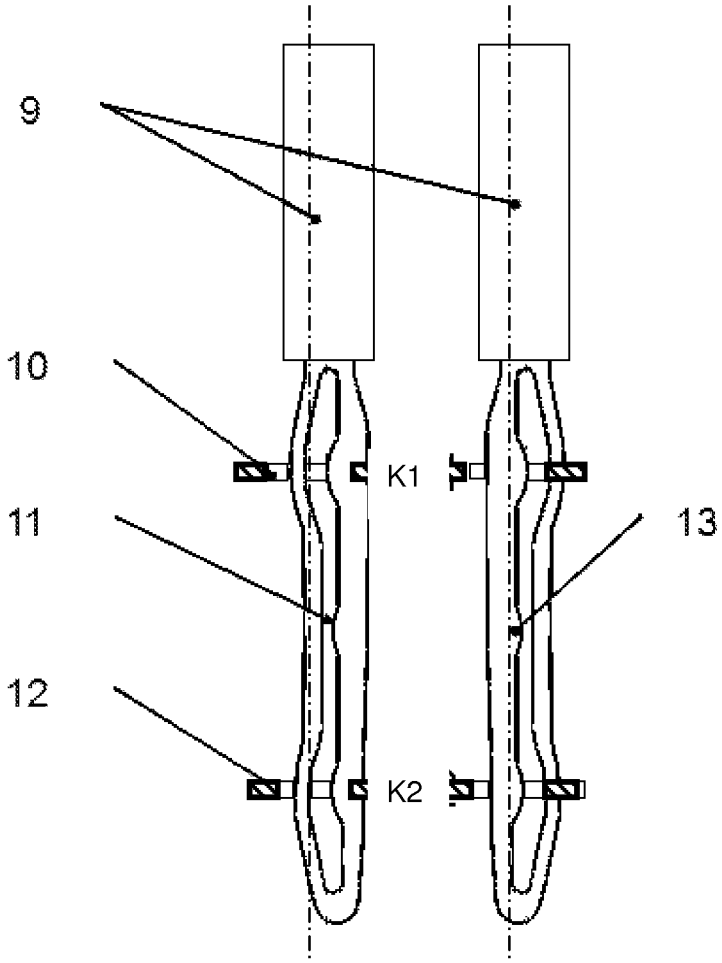
Figure 3:
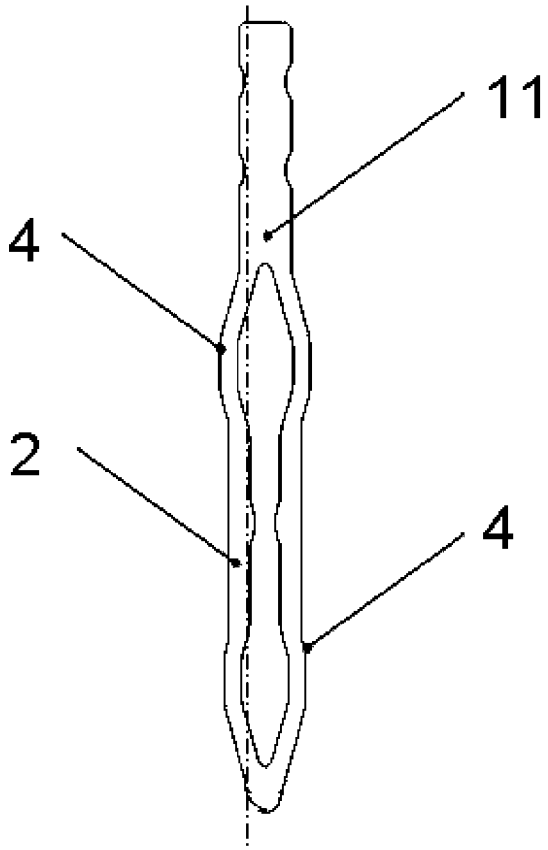
Figure 4:
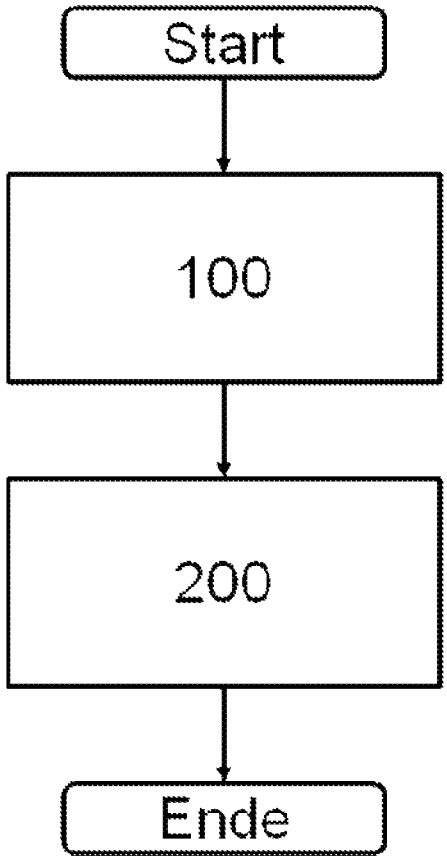
Figure 5:
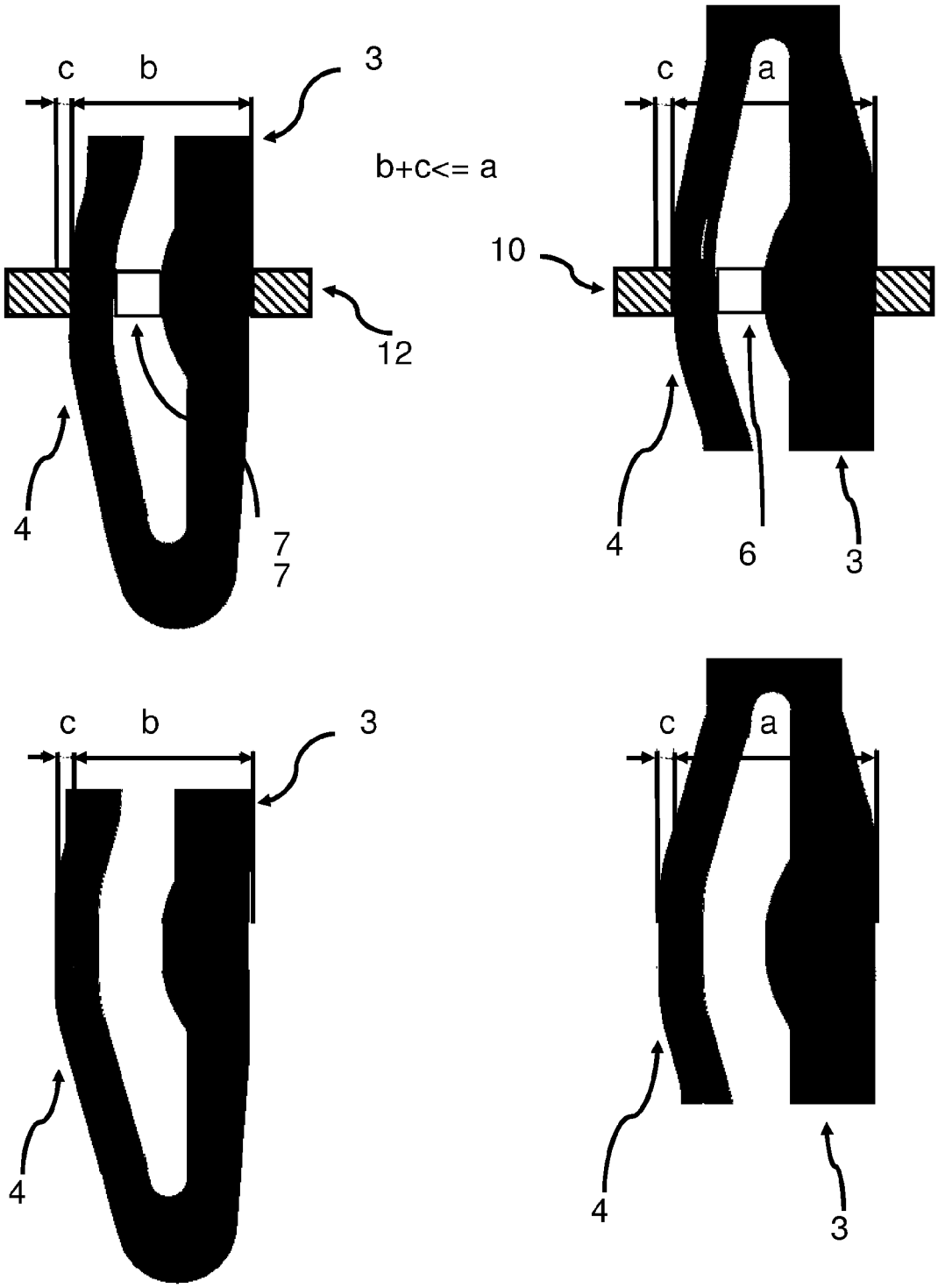

Here it shows:

FIG. 1 a schematic cross-section of a first embodiment of a level bridge according to the invention, FIG. 2 a schematic cross-section of a first embodiment of a level bridge according to the invention in the inserted state, FIG. 3 a detail of a schematic cross-section of a second embodiment of a level bridge according to the invention, FIG. 4 a schematic diagram of the method according to the invention for producing level bridges, and FIG. 5 schematic cross-sections of the contact area of another embodiment of a level bridge according to the invention.

DETAILED DESCRIPTION

FIG. 1 shows a schematic cross-section of a first embodiment of a level bridge according to the invention.

This level bridge for electrically bridging two contacts located on top of each other in a fastener comprises a conductive section 3 for electrically bridging two contacts located on top of each other and an elastic section 4, which allows insertion and secure fastening. The conductive section 3 and the elastic section 4 of the level bridge are embodied in one piece.

This allows a simple manner of production by a single punching tool and simultaneously prevents that any shearing, which was possible in two-part level bridges of prior art, is excluded due to the principle applied.

For this purpose, a level bridge is punched from a sheet 2 in a first step 100 (see diagram of FIG. 4). Here, both the exterior form as well as the clear space between the conductive section 3 and the elastic section 4 is produced. Here, simultaneously the production of both the exterior form as well as the clear space is preferred in a single processing step.

Here, sections 6 and 7 are provided at the conductive section 3, which show a wider surface. During operation, i.e., in the inserted state, these sections 6 and 7 shall essentially create the contacts to the electric contacts K1 and K2.

In this area, fastening shall occur in order to provide a secure contact. Accordingly, projections are provided on the elastic section 4 at approximately the same height as the contact areas 6 and 7 so that they are elastic during the introduction and thus allow the insertion, on the other hand acting in the respective end position such that the contact between the contact areas 6 and 7 and the respective contact K1 and K2 is securely established.

Without further description it is obvious that a larger number of contact areas and allocated elastic areas at the level bridge may also be provided.

Furthermore, the sheet 2 may show an optional shaft 5. Said shaft 5 may show a suitable outer form so that for example an electrically non-conductive section 1 is held reliable and is prevented from falling off, or it may show such a form that a single insertion is possible, however any retraction of the level bridge is prevented by the electrically non-conductive section 1 being pulled off the shaft 5, because the holding force of the elastic section is stronger than the holding force of the electrically non-conductive section 1 at the shaft 5.

In an alternative form it may also be provided for the shaft to comprise a predetermined breaking point 8, where the electrically non-conductive section 1 can be broken off the shaft 5 so that only the lower section of the sheet 2 remains for contacting.

FIG. 2 shows another schematic cross-section of a first embodiment of a level bridge according to the invention in the inserted state. It is discernible from this figure that with a suitable design the level bridge can be used both in an initial direction as well as in a direction rotated by 180° about the axis of symmetry. This is achieved such that the contact areas 6 and 7, in reference to the upper power line 10 and a lower power line 11, are symmetrical to the axis of symmetry 11.

This reduces potential errors and the assembly of level bridges is considerably facilitated. Furthermore, a level bridge according to the invention may also comprise one or more stops 13, which limit the deflection of the elastic section 4. This way the stability of the level bridge can be increased.

Furthermore, these stops 13 may also serve to contact an electric contact in the inserted state.

The electrically non-conductive section 1 may represent for example a spray-coating with a plastic material, which is applied in a step 200.

Due to the level bridge being embodied in one piece the elastic section 4 can also be embodied as a conductive section. This can be considered for dimensioning.

In a preferred manner, the level bridges are produced from a material comprising copper, at least in their elastic section 4 and their conductive section 3.

For example a metallic alloy can be used comprising copper.

Furthermore it may be provided that the elastic section 4 and the conductive section 3 are at least partially galvanized in advance. This may be implemented, e.g., by a prior galvanized sheet metal from which the level bridges are punched.

FIG. 3 shows a detail of a schematic cross-section of a second embodiment of a level bridge according to the invention. In this level bridge both sections are embodied symmetrical in reference to the axis of symmetry. Accordingly, both sections fulfill the function of an elastic section 4 as well as a conductive section 4.

Of course, here too a non-conductive section 1 as well as a predetermined breaking point or stops 13 may also be provided.

Although in the previously stated embodiments the upper contact area K1 and the lower contact area K2 essentially show the same width in the non-inserted state, it may be provided that the upper contact area K1 and the lower contact area K2 show different widths in the non-inserted state.

In particular it is preferred that the upper contact area K1 is wider than the lower contact area K1.

This may be provided both in the level bridge as well as the respective contacts to be contacted.

The insertion is facilitated by the lower width of the lower contact area of the level bridge.

In particular, it can be possible here that there is a common pressure point for both contact areas.

On the one hand this is advantageous for the assembly because now the common pressure point signals the completed assembly, on the other hand it allows for the design of the lower contact area in a more cost-effective fashion because it is no longer required to be designed for the doubled number of plug cycles.

Such an embodiment is shown in FIG. 5, which shows schematic cross-sections of the contact area of another embodiment of a level bridge according to the invention.

Here, the lower contact area shown at the left is embodied such that the distance of the conductive section 3 in reference to the elastic section 4 is selected as b+c, with c representing the deflection, while at the upper contact area shown at the right the passage through the contact shows a width of a.

Due to the fact that the passage width a is greater or identical in the upper contact 10 than the deflected lower contact area (b+c) the contact can easily be pushed through.

In particular it can be allowed here that a common pressure point is given for both contact areas.

This is advantageous, on the one hand for the assembly because now a common pressure point signalizes the finished assembly and on the other hand it also allows designing the lower contact area in a more cost-effective fashion because it no longer needs to be designed for double the number of plugging cycles.

LIST OF REFERENCE CHARACTERS

Non-conductive section 1
Sheet metal 2
Conductive section 3
Elastic section 4
Shaft 5, 9
Contact area 6, 7
Predetermined breaking point 8
Power line 10, 12
Axis of symmetry 11
Stop 13
Electric contacts K1, K2

The invention claimed is:

1. A level bridge for the electric bridging of two contacts positioned on top of each other in a fastener comprising a conductive section for electrically bridging two contacts located on top of each other and an elastic section allowing the insertion and secure fastening, with the conductive section and the elastic section of the level bridge being embodied in one piece, and the conductive section and the elastic section forming a planar, enclosed free space.

2. A level bridge according to claim 1, with the level bridge comprising an electrically non-conductive section for inserting into and/or retracting from a level clamp.

3. A level bridge according to claim 1, with the conductive section comprising one or more stops limiting the deflection of the elastic section.

4. A level bridge according to claim 1, with the conductive section comprising one or more stops in the inserted state serving to contact an electric contact.

5. A level bridge according to claim 1, with the elastic section also being embodied as a conductive section.

6. A level bridge according to claim 1, with the elastic section and the conductive section being made from a material comprising copper.

7. A level bridge according to claim 1, with the elastic section and the conductive section being galvanized in advance, at least partially.

8. A level bridge according to claim 1, with the level bridge comprising a detachable section only serving for inserting and breaking off during an attempt of retraction.

* * * * *